US005975326A

United States Patent [19]

Monz

[11] Patent Number: 5,975,326

[45] Date of Patent: Nov. 2, 1999

[54] POLYGONAL WASTE CONTAINER FOR NOXIOUS MATERIALS WITH A DOUBLE-LID CLOSURE STRUCTURE

[75] Inventor: Michael Monz, Bottrop, Germany

[73] Assignee: Forschungszentrum Karlsruhe GmbH, Karlsruhe, Germany

[21] Appl. No.: 08/944,611

[22] Filed: Oct. 6, 1997

[30] Foreign Application Priority Data

Oct. 28, 1996 [DE] Germany ..... 296 18 735 U

[51] Int. Cl.[6] ..... B65D 45/00

[52] U.S. Cl. ..... 220/246; 220/251; 220/315; 220/669; 220/732

[58] Field of Search ..... 220/315, 323, 220/255, 256, 243, 246, 249, 251, 592.01, DIG. 13, 732, 648, 669, 671, 245

[56] References Cited

U.S. PATENT DOCUMENTS

| | | | |
|---|---|---|---|
| Re. 3,299 | 2/1869 | Lindergreen | 220/DIG. 13 X |
| 72,916 | 12/1867 | Scott | 220/DIG. 13 X |
| 560,659 | 5/1896 | Stern | 220/648 X |
| 1,191,432 | 7/1916 | Jones | 220/243 X |
| 1,326,087 | 12/1919 | Parish | 220/323 |
| 1,427,525 | 8/1922 | Felten | 220/732 X |
| 2,016,512 | 10/1935 | Pinney et al. | 220/669 X |
| 2,322,704 | 6/1943 | Seltzer | 220/650 |
| 2,675,940 | 4/1954 | Schmitz | 220/650 |
| 3,689,738 | 9/1972 | Laing | 219/378 |
| 3,768,706 | 10/1973 | Hill | 220/256 X |
| 3,997,078 | 12/1976 | Melton et al. | 220/315 |
| 4,055,274 | 10/1977 | Waldenmeier et al. | 220/315 X |
| 4,112,916 | 9/1978 | Guibert | 220/DIG. 13 X |
| 4,333,579 | 6/1982 | Flood | 220/669 X |
| 4,467,936 | 8/1984 | Makhijani | 220/323 X |
| 4,891,910 | 1/1990 | Cook et al. | 220/323 X |
| 5,148,938 | 9/1992 | Morgan, Jr. | 220/323 X |
| 5,669,524 | 9/1997 | Loedel | 220/669 X |
| 5,762,227 | 6/1998 | Mitchell | 220/321 |

FOREIGN PATENT DOCUMENTS

| | | | |
|---|---|---|---|
| 1037897 | 5/1958 | Germany | 220/323 |

*Primary Examiner*—Stephen K. Cronin
*Attorney, Agent, or Firm*—Klaus J. Bach

[57] ABSTRACT

In a waste container for containing noxious materials, wherein the container is provided with a double lid structure having an inner lid by which the container can be closed and which has a head by which the inner lid can be grasped for engagement with the outer lid which is part of a containment to which the container is attached for the transfer of noxious materials, the container consists of planar wall sections which are disposed at an angle with respect to one another such that the container has a polygonal shape whereby such containers can be stored closely adjacent one another and the container has a corresponding polygonal opening and has a lid which is also polygonal like the container.

5 Claims, 1 Drawing Sheet

POLYGONAL WASTE CONTAINER FOR NOXIOUS MATERIALS WITH A DOUBLE-LID CLOSURE STRUCTURE

BACKGROUND OF THE INVENTION

The present invention relates to a waste container for noxious materials which container can be closed by a lid arrangement, that is, a container lid by which the container can be closed and which includes a head by which it can be coupled to another lid which is pivotally supported on, and closes, a containment including noxious materials. The container lid includes a flat surface for sealing engagement with a circumferential container seal structure.

For the disposal of noxious materials in containers, so-called double-lid closure structures are used in which one lid of the double-lid closure structure remains attached to the container and the other to a containment. When the container is disposed with its lid adjacent the containment lid the two lids are coupled to one another closely adjacent each other for removal of the container lid from the container opening together with the containment lid. After the containers are filled with noxious materials they are closed and stored in storage facilities. Such double-lid closure structures have been used so far only for round containers such as barrels which however, as a result of their shape, require a relatively large amount of storage space since empty spaces will remain between adjacent containers.

It is the object of the present invention to provide a waste container for noxious materials which, on one hand is suitable for double lid closure structures and, on the other hand, requires less storage space than the round containers presently in use.

SUMMARY OF THE INVENTION

In a waste container for containing noxious materials, wherein the container is provided with a double lid structure having an inner lid by which the container can be closed and which has a head by which the inner lid can be grasped for engagement with the outer lid which is part of a containment to which the container is attached for the transfer of noxious materials, the container consists of planar wall sections which are disposed at an angle with respect to one another such that the container has a polygonal shape whereby such containers can be stored closely adjacent one another and the container has a corresponding polygonal opening and has a lid which is also polygonal like the container.

Details of the invention will be disclosed in the following description on the basis of the accompanying drawings.

DESCRIPTION OF A PREFERRED EMBODIMENT

Figure 1:
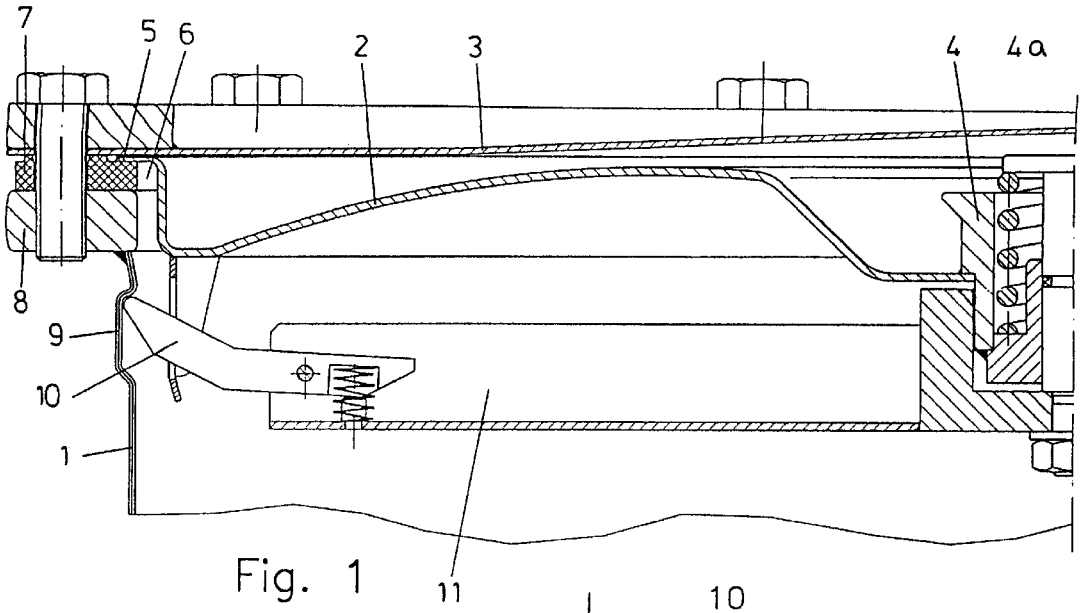
FIG. 1 is a cross-sectional view of the closure structure of a container.
Figure 2:
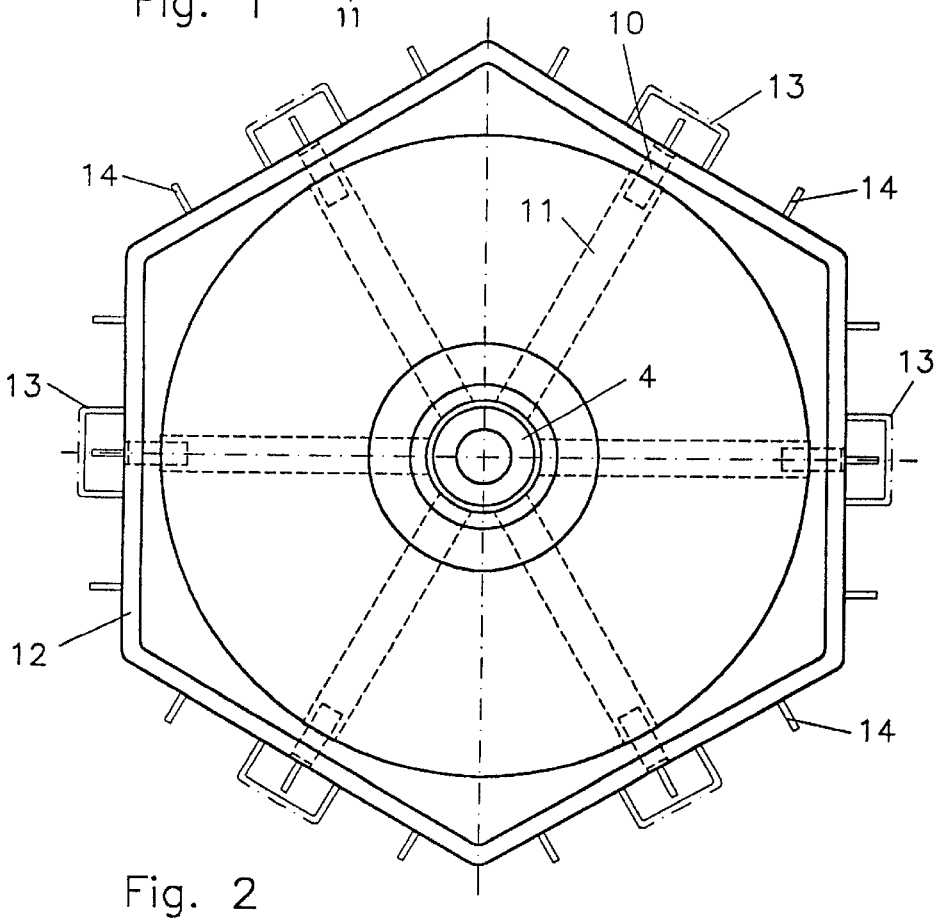
FIG. 2 is a top view of the closure structure shown in FIG. 1.

FIG. 1 is a cross-sectional view of the closure head of a waste container 1 for noxious materials. The container 1 is closed by a cover utilizing a double lid arrangement, that is, an inner lid 2 by which the container is closed and which can be engaged by an outer lid 3. The container 1 can be attached to the containment such that its opening is disposed adjacent the opening of the containment for transferring noxious materials between the containment and the container. During transportation of the container the lid 2 is closed and the outer lid 3 is bolted onto the container, which serves only safety purposes. The inner lid 2 is provided in its center with a grasping head 4 for coupling it to, and uncoupling it from, the outer lid which is not shown as such arrangements are well known in the art. When coupled together the inner and outer lids can be pivoted open in unison. The inner lid 2 further includes a planar engagement surface 5 with which it is disposed on a container seal 7, which is mounted on the container flange 8 and extends around the container opening 6. The container opening 6 has about the same size as the container at its upper edge.

The container 1 includes, adjacent its upper end a circumferentially extending outwardly projecting recess 9 into which locking levers 10 can extend for retaining the lid 2. The locking levers 10 are supported below the lid 2 on support arms 11 of a locking star structure, which can be moved axially by holding the grasping head 4 and pressing down the center pin 4a for pivoting the levers 10 into the recess 9. Instead of the circumferential recess 9, the container may be provided with individual recesses for the various locking levers 10. Such individual recesses may include several spot-like or elongated impressions.

The side walls, that is, respectively, the outer surfaces of the container 1 consist of flat sections which are disposed at an angle with respect to one another. The container 1 has accordingly, the shape of a polygon, for example, a hexagonal, a triangular, a rectangular or a square shape so that the containers 1 can be arranged adjacent one another without spaces therebetween. The container openings 6, as well as, the inner lid 2 of the double lid structure, which extends into the opening 6 have the same polygonal shape, that is, a hexagonal, a triangular, a rectangular, or a square shape like the container itself. For each of the planar side wall sections 12 of the container, there is provided a support arm 11 of the star-like locking structure having mounted thereon the locking levers 10 for locking the lid 2. With a waste container having a hexagonal shape that is six planar side wall sections 12, the lid 2 may have only three support arms 11 with locking levers 10 whereby then only every other side wall section of the waste container 1 would be engaged. On the other hand, it is possible to provide for each of the planar side wall sections 12 more than one support arm and the respective locking levers 10.

There may be provided on the side wall sections of the container 1 additionally outer axially extending distance stop structures 13, which insure that an air space is maintained between adjacent containers when they are stored adjacent one another, and which may also serve as a heat exchange rib structure. Furthermore, additional axially extending heat exchange ribs 14 may be disposed on the various side wall sections of the container.

What is claimed is:

1. A waste container for noxious materials with a closure arrangement including a lid structure having an inner lid for closing the container, said inner lid having a head adapted to be grasped by the lid of a containment for effecting engagement thereof with, and disengagement thereof from, said containment lid, said container including a circumferential flange having a top surface with a seal structure and said container lid having a planar engagement surface for sealing engagement with said seal structure on the top surface of said circumferential flange, said container having planar wall sections disposed at an angle with respect to one another such that said container has a hexagonal shape with planar side wall sections, whereby a number of such containers can be stored closely adjacent one another without unnecessary spaces therebetween, and said container further having a respective hexagonal opening and said lid disposed in said hexagonal opening also having the same hexagonal shape as said container and having about the same size as the container has an internal cross-section at its upper end, and said planar side wall sections having outwardly projecting recesses formed therein and said container lid including support arms, which extend toward said planar side wall sections and carrying locking levers which are pivotable so as to extend into said recesses for engagement of said container lid with the container walls.

2. A waste container according to claim 1, wherein said container has six planar side wall sections and said lid has three support arms with locking levers engaging every other of said six planar side wall sections.

3. A waste container according to claim 1, wherein stop structures are disposed on the side wall sections of said container whereby adjacent containers are held at a predetermined distance from each other.

4. A waste container according to claim 3, wherein axially extending heat exchange ribs are disposed on the side wall sections of said container.

5. A waste container according to claim 1, wherein one support arm with a locking lever is provided for each side wall section of said container.

* * * * *